US007293432B2

(12) United States Patent
Jürgens

(10) Patent No.: US 7,293,432 B2
(45) Date of Patent: Nov. 13, 2007

(54) APPARATUS FOR PRODUCING A KNITTED FABRIC WITH INTERSPACING

(75) Inventor: Eric Jürgens, Bisingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/641,781

(22) Filed: Dec. 20, 2006

(65) Prior Publication Data

US 2007/0144219 A1 Jun. 28, 2007

(30) Foreign Application Priority Data

Dec. 23, 2005 (DE) ..... 10 2005 062 403

(51) Int. Cl.
*D04B 15/38* (2006.01)

(52) U.S. Cl. ..... 66/93

(58) Field of Classification Search ..... 66/90–93, 66/17–19

See application file for complete search history.

(56) References Cited

U.S. PATENT DOCUMENTS

| | | | | |
|---|---|---|---|---|
| 2,399,002 A | | 4/1946 | Coile | |
| 3,041,859 A | * | 7/1962 | Lie et al. | 66/92 |
| 3,874,197 A | * | 4/1975 | Plath | 66/12 |
| 4,043,151 A | * | 8/1977 | Schmidt | 66/9 R |
| 6,122,690 A | | 9/2000 | Nannetti et al. | |
| 6,128,930 A | * | 10/2000 | Schmidt | 66/92 |
| 6,915,666 B2 | | 7/2005 | Willmer | |
| 2003/0089135 A1 | | 5/2003 | Sangiacomo | |

FOREIGN PATENT DOCUMENTS

| | | |
|---|---|---|
| CH | 618 223 A5 | 7/1980 |
| DE | 43 01 242 A1 | 7/1994 |
| DE | 103 20 533 A1 | 11/2004 |
| FR | 2 751 351 A1 | 1/1998 |

* cited by examiner

*Primary Examiner*—Danny Worrell
(74) *Attorney, Agent, or Firm*—Fitch Even Tabin & Flannery; Norman N. Kunitz

(57) ABSTRACT

An apparatus according to the invention for producing a knitted fabric with interspacing is embodied in the form of a circular knitting machine with knitting cylinders or with a knitting cylinder and a dial. Between the two needle beds for the needle assemblies defined in this way, a pile thread transfer device 4 is arranged, which is preferably provided with two groups 5, 6 of feed elements that can respectively be moved from an idle position to a thread tucking position. In the process, the feed elements of the one group move toward the needle hooks of the first needle bed and the feed elements of the other group move toward the needle hooks of the other needle bed. In this way, a spaced apart knitted fabric can be produced on circular knitting machines, wherein latch needles can be used and the needle stroke is limited to the standard measure of less than 14 mm. The knitted fabric with interspacing can have a thickness of clearly more than 14 mm, meaning a thickness than far exceeds the needle stroke.

18 Claims, 8 Drawing Sheets

APPARATUS FOR PRODUCING A KNITTED FABRIC WITH INTERSPACING

CROSS REFERENCE TO RELATED APPLICATION

This application claims the priority of German Patent Application No. 10 2005 062 403.0-26 filed Dec. 23, 2005, the subject matter, in its entirety, is incorporated by reference.

BACKGROUND OF THE INVENTION

The invention relates to an apparatus for creating a knitted fabric with interspacing, in particular a knitted fabric with a spacing of more than 14 mm between surfaces. The invention furthermore relates to a method for producing such a knitted fabric with interspacing.

Textile materials with spaced apart surfaces are frequently used for industrial textiles and specific functional clothing, wherein both textile surfaces are connected by pile threads. Known are only knitted fabrics with interspacing ranging from 3 mm to 14 mm between surfaces, as well as weft and woven fabrics up to a height of 60 mm and above. The height represents the distance between the two textile surfaces, which are connected to each other by a pile thread, wherein a monofilament thread is frequently used as pile thread. Alternative to weft and woven fabrics with interspacing, a knitted fabric can be produced on a circular knitting machine with knitting cylinder and dial. For example, the one knitted fabric surface in the shape of a tube is produced with the needles of the dial and the other, also tubular knitted fabric surface is produced with the needles of the knitting cylinder. Both knitted surfaces are connected by the back and forth moving monofilament thread. The distance between the knitted surfaces depends on the distance between the knitting cylinder and the dial.

The spacing between the dial and the knitting cylinder, however, cannot be optionally large to satisfy the desire to have larger distances between knitted surfaces because the distance between dial and knitting cylinder must be bridged by the needles in the extended state. A longer distance inside the needle cam is required for a further extension of the needles, meaning longer cams have to be used. If longer cams are used, the productivity of the machine is reduced by the same degree because longer cams mean that fewer cam curves are possible over the circumference of a circular knitting machine. The system number at the diameter for the circular knitting machine is thus reduced, which results in fewer rows of loops per machine rotation.

A circular knitting machine for producing knitted fabrics with interspacing is known from document DE-OS 103 20 533. For the loop forming, compound needles are used for at least one embodiment of this machine. Distances between the knitted surfaces of up to 14 mm can be realized with this machine.

However, compound needles require cams which have a cam curve not only for the needle, but also for the closing element. Cams of this type are more involved than cams for latch needles. In addition, the use has limits if the distances between the knitted surfaces must exceed 14 mm because longer cams are needed in that case as a result of the excessive extension. In that case the above statement relating to the productivity of the knitting machine applies. If longer cams are used, the productivity of the machine is reduced by the same degree because longer cams mean that fewer cam curves are possible over the circumference of a circular knitting machine.

When producing knitted fabrics with interspacing using latch needles, the distance between both textile surfaces among other things depends on the length of the latch and/or the hinge for the latch needles. The connecting thread for both textile surfaces must be inserted into the dial needle as well as the cylinder needle during the tie up in the tuck position. In the process, the two needles can be extended maximally far enough, so that the thread positioned in the hook, which is used for the loop forming, remains on the needle latch that is still in the rear or retracted position and does not slide across the inside edge of the needle latch and onto the needle shank. Thus, the distance between both textile surfaces when using latch needles is limited to their maximum latch motion. This is true in particular for a knitting machine as disclosed to document U.S. Pat. No. 6,122,690, for which two needle cylinders are arranged coaxially opposite each other. Both needle cylinders are provided with latch needles. This document discloses the transfer of the loops from a needle on a first knitting cylinder to a needle on a second knitting cylinder. When using the knitting cylinder arrangement according to document U.S. Pat. No. 6,122,690 for producing knitted fabrics with interspacing, the distance between two knitted textiles is limited by two times the latch motion less one time the hook size, since the pile thread is inserted into both hooks of the knitting machine needles. Knitted fabrics with an interspacing of approximately 10 mm between the knitted surfaces can thus be produced.

SUMMARY OF THE INVENTION

Starting from the above background, it is the object of the present invention to provide an apparatus for producing a knitted fabric with interspacing, using only latch needles as required. In addition, it is the object of the present invention to provide a corresponding method.

This object is solved according to a first aspect of the invention by an apparatus for generating a knitted fabric with interspacing, having at least a first knitted surface and at least a second knitted surface, between which a pile thread extends that connects the two knitted surfaces and keeps them at a distance to each other, comprising a first group of needles that are positioned displaceable in a longitudinal direction inside a first needle bed and are connected to a driving device for the controlled movement in longitudinal direction, with these needles forming a first needle assembly;

a second group of needles that are positioned displaceable in a longitudinal direction inside a second needle bed and are connected to a driving device for the controlled movement in longitudinal direction, with these needles forming a second needle assembly;

a group of movably positioned feed elements, which are connected to a driving device for a controlled movement, wherein these feed elements have a functional section designed for guiding a pile thread.

The above object is solved according to a second aspect of the invention by a method for producing a knitted fabric with interspacing, comprising at least a first knitted surface and at least a second knitted surface, between which a pile thread extends that connects the knitted surfaces while keeping them at a distance to each other, with the aid of at least two needle assemblies, arranged at a distance to each other, and with the aid of a transfer element assembly for guiding the pile thread back and forth between both knitted surfaces, wherein the knitted surfaces are created in a single knitting operation and the pile thread is alternately tied into the knitted surfaces.

The apparatus according to the invention uses two groups of needles, which respectively form a needle assembly and are used for producing a knitted fabric surface, wherein sections or legs of a pile thread extend between the two knitted fabric surfaces. This pile thread is guided by a group of feed elements to the tuck region of the needles of one or the other needle assembly, such that it can be anchored in the respective knitted fabric surface. The distance between the two needle assemblies is thus bridged by the feed elements. The length of the distance is thus no longer defined by the maximum possible needle extension or, in the case of latch needles, the distance between the latch tip in latch back position and the needle hooks. With latch needles, this distance determines the path which a loop or partial loop held by the hook can travel until it glides over the opened latch in the back position and is thus knocked over when the needle is retracted. The apparatus according to the invention therefore is suitable in particular for the use with latch needles, wherein compound needles can in principle also be used. The needle extension can be limited to the measure that is standard for single-layer knitted fabric, wherein only short needle strokes and thus small cam curves are needed. Correspondingly, a great many knitting systems can be installed on a circular knitting machine and a great many loop rows can be generated during one cylinder rotation. The apparatus according to the invention thus permits an economic operation even when producing knitted fabrics with interspacing, for which the spacing between surfaces is more than 14 mm.

The knitting machine according to the invention furthermore makes it possible to produce knitted fabrics with interspacing, which not only have a high number of loop rows per rotation (high system density), but also a high number of rotations for the knitting cylinder. The short extension of the latch needles that is required approximately matches the extension required for producing simple, smooth knitted fabric. With a correspondingly high number of rotations and the resulting productivity, knitted fabrics with interspacing can be produced.

In principle, it is possible to design the feed elements in such a way that they can move back and forth between two thread transfer locations, namely the thread transfer location for the first needle assembly and the thread transfer location for the second needle assembly. However, it is preferred if the feed elements move between a passive location and a thread transfer location. The passive location here is located approximately halfway on the path between both thread transfer positions. With one preferred embodiment, the group of feed elements is divided into two partial groups. The first partial group is assigned to the needles of the first needle assembly, while the second partial group is assigned to the needles of the second needle assembly. Each needle assembly thus has so-to-speak its own pole-thread feeder in the form of feed elements. This concept permits the adjustment of extremely short distances between the assemblies and thus also extremely short distances between the knitted fabric surfaces, as well as the adjustment of extremely long distances between knitted fabric surfaces.

In principle, the feed elements can be moved in different ways, wherein they are preferably positioned and displaced in longitudinal direction. The feed movement or thread transfer movement in that case can be achieved with the aid of a cam, in the same way as the knitting tool movement (needles, particularly latch needles), which engages in the butts of the feed elements.

The concept according to the invention is generally suitable for knitting machines, even flat knitting machines. However, it is advantageously used with circular knitting machines, wherein the first needle bed is embodied as a knitting cylinder. The second needle bed can be a knitting cylinder or a dial. In both cases, the second needle bed (knitting cylinder or dial) is preferably aligned coaxial to the first needle bed. The knitting machine obtained in this way can be adjusted to have varied spacing between the knitted fabric surfaces and thus the length of the pile thread legs by varying the distance between the two knitting cylinders or between the dial and the knitting cylinder. The feed elements can be arranged in a sinker, ring, positioned adjacent to the gap between the two knitting cylinders and/or between the dial and the knitting cylinder. In this sinker ring, the feed elements of both above-mentioned groups are preferably arranged and oriented at an angle to each other. They can furthermore be moved in directions which are at the aforementioned angle relative to each other, preferably at a right angle. This is particularly true in the case of the circular knitting machine with dial and knitting cylinder. In the case of a circular knitting machine with two knitting cylinders, this angle can also be a right angle or an angle different from a right angle. The advantage of this arrangement is that the feed elements in the passive position (pulled-back position) free the space between the hooks of the two needle assemblies.

A plane that is parallel to the flat sides of the feed elements and thus to the guide slot walls for the one group of feed elements is preferably parallel to a plane, which is parallel to the flat sides of the needles and/or the needle slot walls. The same is true for the second group of feed elements and needles, in particular when using a circular knitting machine with dial and knitting cylinder. A clear and functionally secure design is thus obtained. For a circular knitting machine provided with two knitting cylinders, the angle between the guide for the feed element and the guide for the associated needle is approximately 45 degrees, wherein this angle is less than 45 degrees for one preferred embodiment.

The feed elements can alternatively also be installed in the needle beds, for example by providing additional slots for the feed elements between the needle slots. Alternatively, individual needle slots can be used for feed elements instead of needles. The feed elements in that case are extended further than the needles to bridge the distance between the two needle assemblies. In individual cases, it may be sufficient to provide feed elements only in one needle bed, especially if the feed elements can move the pile thread by pushing it as well as pulling it. For the preferred embodiment, however, both needle beds are provided with feed elements. The pile thread is then moved by the respective feed element only by pushing it. In that case, the feed element can be embodied like a narrow closing element, provided at its end with a notch for holding the thread.

The feed elements can be embodied solid, but are preferably embodied with an end section consisting of two lamellas. Alternatively, they can also consist only of two lamellas, which fit against each other, for example thin steel lamellas or steel strips that preferably have identical contours. They can fit loosely against each other or can be connected to each other. The lamellas allow a needle hook to be retracted between them, wherein they can be spread out somewhat to facilitate the transfer of the thread from the feed element to the needle.

Further details of advantageous embodiments of the invention follow from the drawing, the specification, or the claims.

BRIEF DESCRIPTION OF THE DRAWINGS

Exemplary embodiments of the invention are illustrated in the drawing, wherein.

DETAILED DESCRIPTION OF THE INVENTION

Figure 1:
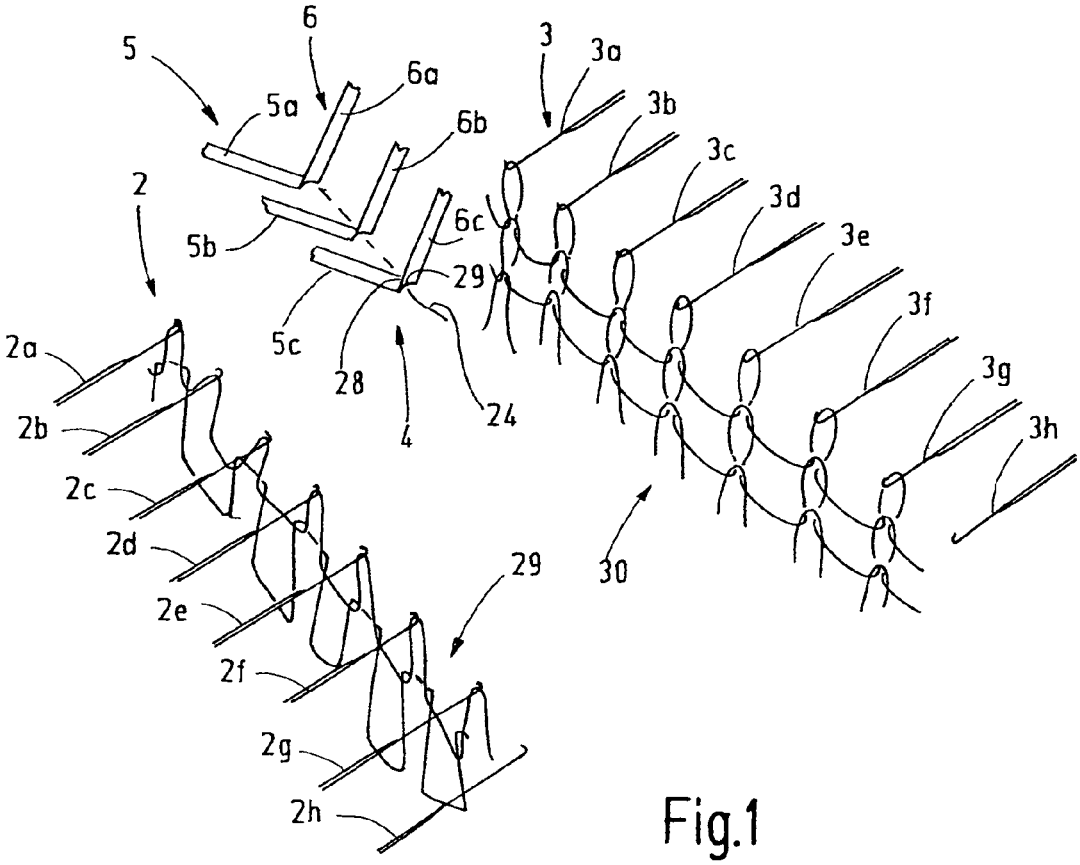
FIG. 1 is an extremely diagrammatic representation of a circular knitting machine, showing details of the needle assemblies and several feed elements with knitted fabric.

FIG. 1 shows a detail of a knitting machine 1, in the form of a first needle assembly 2 that consists of individual needles 2*a* to 2*h*, embodied as latch needles, and a second needle assembly 3 consisting of latch needles 3*a* to 3*h*, which are also embodied as latch needles. The needles 2*a* to 2*h* of the first needle assembly 2 are preferably offset by one half divisions, relative to the needles 3*a* to 3*h* of the second needle assembly 3. FIG. 1 furthermore illustrates a pile thread transfer device 4, comprising a first group 5 of first feed elements 5*a*, 5*b*, 5*c* and a second group 6 of second feed elements 6*a*, 6*b*, 6*c*. Owing to the fact that FIG. 1 only illustrates a detail of the total knitting system of the knitting machine, it is understood that the actual number of needles 2*a* to 2*h*, 3*a* to 3*h* and the feed elements 5*a* to 5*c*, 6*a* to 6*c* is considerably higher than shown herein. Individually, each needle 2*a* to 3*h* can be assigned one feed element, if necessary, for generating numerous pile thread legs. However, it is also possible to use a lower number of feed elements if fewer pile thread legs must be generated.

Figure 8:
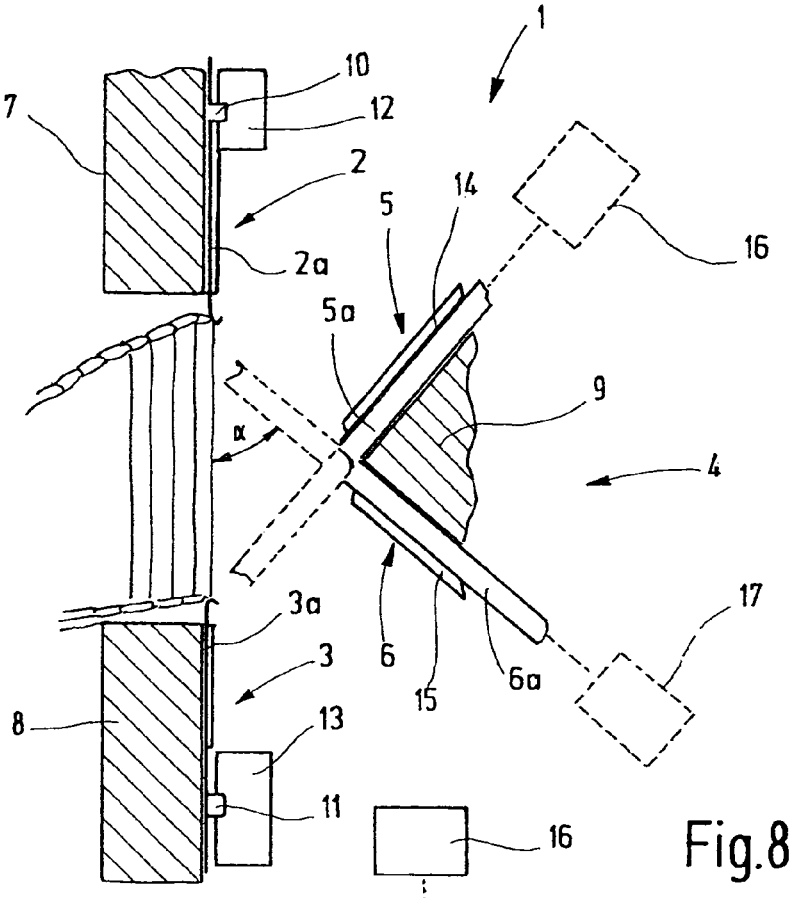
FIG. 8 is an illustration of a circular knitting machine with two knitting cylinders, arranged coaxial to each other, and a sinker ring for feed elements, shown in a schematic representation.

The knitting system illustrated in FIG. 1 can be used either as flatbed knitting system or as knitting system for a circular knitting machine. In the latter case, the needles 2*a* to 3*h* are accommodated in the needle slots of the knitting cylinders 7, 8, which are arranged axially spaced apart and coaxial to each other as shown in FIG. 8. The feed elements 5*a* to 6*c* of the group 5, 6 are arranged inside corresponding guides or slots in a sinker ring 9. The sinker ring can be arranged in the space provided between the two knitting cylinders 7, 8 and can have a somewhat larger diameter than these cylinders.

The needles 2*a* to 3*h* are arranged parallel to each other around the circumference of the knitting cylinders 7, 8 and are provided with butts 10, 11. The butts engage in driving devices, meaning with cams 12, 13, which function to move the needles 2*a* to 3*h* in axial or needle longitudinal direction during the rotation of the respective knitting cylinder 7, 8. The needles 2*a* to 3*h* are thus extended and retracted, with the loop being formed in the process. Nearly all known latch needles with freely moving latches are suitable for use as needles 2*a* to 3*h*. A special latch control can also be provided, but is not necessary.

The sinker ring 9 preferably contains a group of guides 14 in the form of parallel-arranged, narrow slots for the feed elements 5*a* to 5*c* of the group 5, wherein these slots can accommodate the feed elements 5*a* to 5*c*, such that they are displaceable in longitudinal direction. The sinker ring 9 is furthermore provided with a group of additional guides 15 for accommodating the feed elements 6*a* to 6*c* of group 6, such that they are displaceable in longitudinal direction. The guides 14 of the one group are arranged parallel to each other. The guides 15 of the other group are also arranged parallel to each other. The guides 14, 15 of both groups together enclose an angle of approximately 90 degrees, as shown in FIG. 8. As a result, an angle $\alpha$ of approx. 45° results between the movement direction of the needles 2*a* and the movement direction of the associated feed element 6*a*. The angle $\alpha$ between the needles 3*a* and the associated feed element 5*a* is also approx. 45°.

Embodiments are also conceivable where the angle $\alpha$ between the needle 3*a* and the associated feed element 5*a* is preferably smaller than 45 degrees and the angle between the guides 14, 15 is thus an obtuse angle According to one special embodiment (not shown herein), it is possible to arrange the guides 14, 15 parallel to the knitting cylinders 7, 8, particularly their needle guides. They are consequently arranged coaxial to each other and preferably connected seamlessly, as one piece. In that case, it is possible to provide the feed elements 5, 6 with a hook-shaped end, designed to pull the pile thread in the direction of the needles 2, 3 into which it is to be inserted and not, as described in the above, feed it in by pushing it. With this type of arrangement, the movement sequence for inserting the pile thread into the hook 25 of a needle 2, 3 is reversed as compared to the above example. This can have advantages when the pile thread is picked up by the feed elements 5, 6 as well as during the insertion into the hook 25 of the needles 2, 3. The pile thread is moved between the knitted surfaces by pulling it and not by pushing it.

Individual driving devices 16, 17, which are only indicated schematically in FIG. 8, are assigned to the feed elements 5*a*, 6*a*, as well as all other feed elements, wherein these driving devices are cams, for example, which engage in the butts of the feed elements 5*a* to 6*c*. If the cams have cam curves and are arranged stationary and if the sinker ring, 9 rotates synchronously with the knitting cylinders 7, 8, then the feed elements 5*a* to 6*c* are extended and retracted corresponding to the shape of the associated cam curves. The extended position of the respective feed element 5*a*, 6*a* is shown with dashed lines in FIG. 8.

Figure 7A:
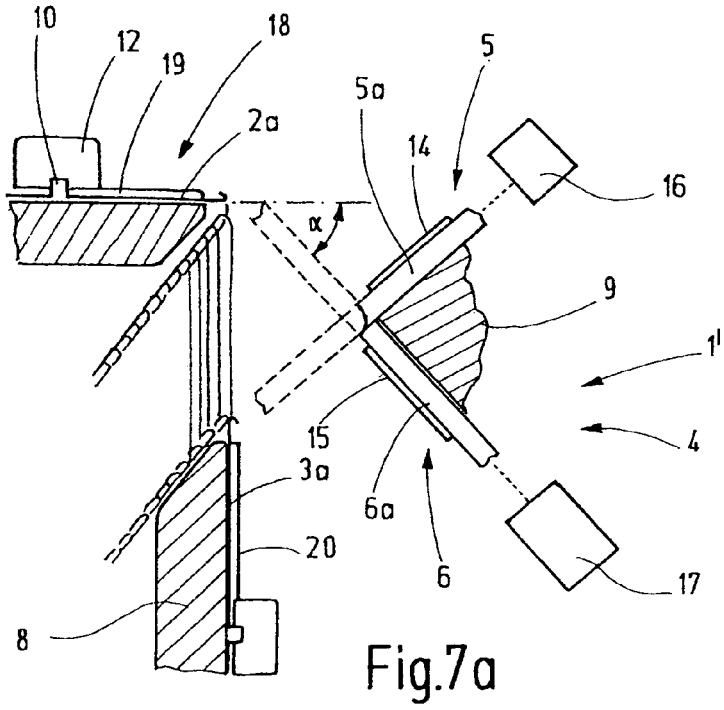
FIG. 7*a* is an illustration of a modified embodiment of a circular knitting machine with dial, knitting cylinder, and sinker ring for the feed elements, shown in a schematic representation.
Figure 7:
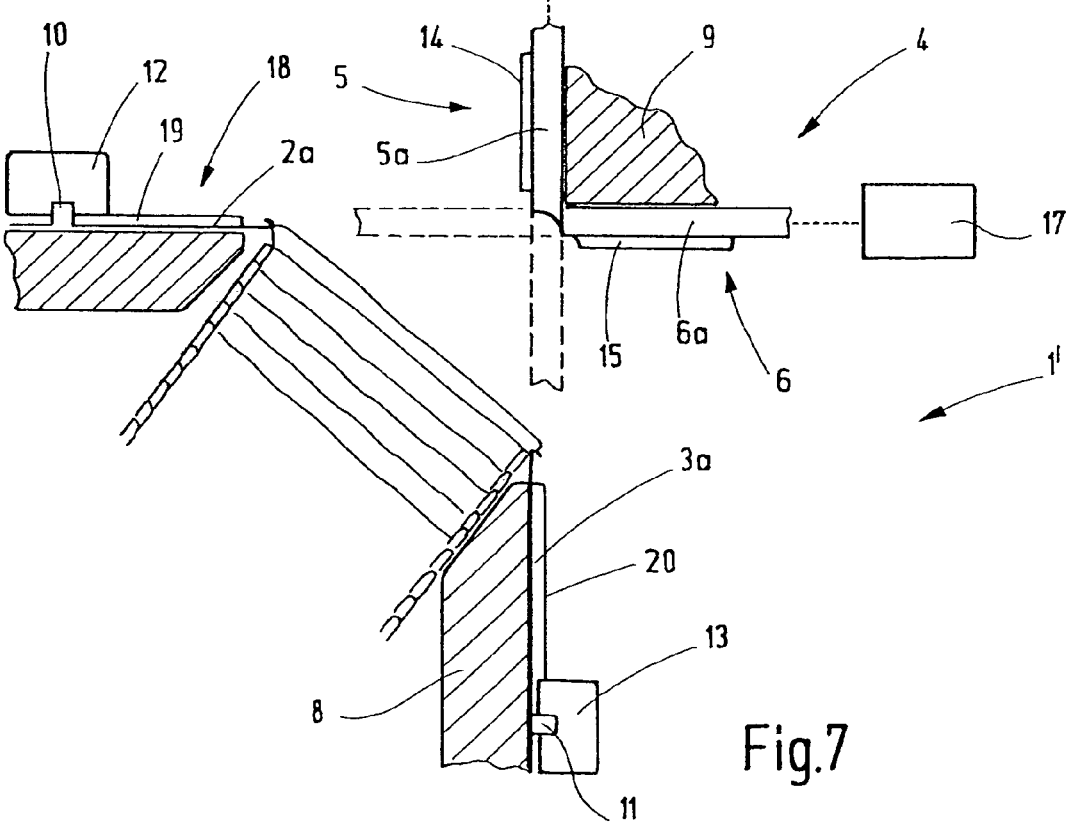
FIG. 7 is an illustration of a circular knitting machine with dial, knitting cylinder and sinker ring for the feed elements, shown in a schematic representation.

FIG. 7 shows a circular knitting machine 1', provided with a dial 18 instead of an upper knitting cylinder 9, which forms a needle bed in the same way as the knitting cylinders 7, 8. The dial is provided with a number of slots extending in radial direction, which form the guides 19 for the therein positioned respective needle 2*a* (to 2*h*). The needles 2*a* of the dial 18 are thus essentially arranged at a right angle to the needles 3*a* to 3*h* of the knitting cylinder 8. Between the hooks of the needles for the dial 18 and the hooks of the needles on the knitting cylinder 8 exists a gap, the size and/or width of which determines the distance between the knitted surfaces of the knitted fabric with interspacing to be produced. The feed elements 5*a* to 6*c* are again held inside a sinker ring 9. The guide 15 of the feed element 6*a* is aligned with the guide 19 of the needle 2*a*. In the same way, the other guides of the feed elements for group 6 are aligned with the corresponding guides of the dial 18. The guide 14 for the feed element 5*a* is aligned with the guide 20 of the needle 3*a*. Correspondingly, the other guides 14 for the feed elements of the group 5 are aligned with the corresponding guides of the knitting cylinder 8, which causes the pile thread 24 to be positioned opposite the hook inside space, approximately midway of the hook height. So that the feed elements 5, 6 can insert the pile thread 24 into the hook inside space, means (not shown herein) are provided in the form of bevels or ramps. These insertion means can be formed onto the needles 2, 3 as well as the feed elements 5, 6. It is furthermore possible to superimpose different movement components onto the feed elements 5, 6, in addition to the above-described translational movement, for example tilting movements, to facilitate the transfer of the pile thread to the needles 2, 3. It is also possible to embody the sinker ring 9, as indicated in FIG. 7*a*, with a different orientation, so that an acute angle is created between the respective guides for the needles and the feed elements associated therewith.

Figure 5:
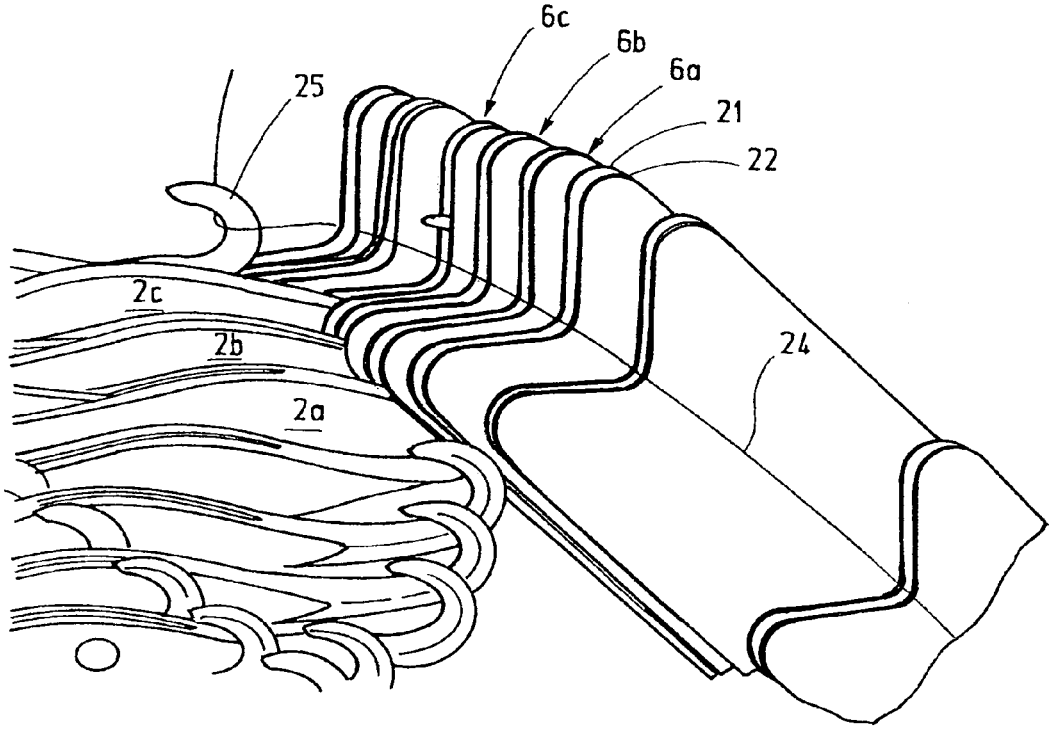
FIG. 5 illustrates latch needles for the dial and feed elements shown in a sectional, perspective representation.

The feed elements 5*a* to 6*c* are shown only schematically in FIGS. 1 to 4 as well as 7 and 8. For a further explanation of the embodiments of same, we point to FIGS. 5 and 6, wherein the machine configuration according to FIG. 7*a* is representative. FIG. 5 illustrates the needles 2*a*, 2*b* etc. on the dial, as well as the feed elements 6*a*, 6*b*, 6*c* (and others). As can be seen, the feed elements respectively consist of two lamellas 21, 22, which are embodied as strips of flexible steel that extend along the movement direction and are delimited by parallel edges. The two lamellas 21, 22 advantageously have identical outlines and are provided on the end with an angular cutout 23, which defines a right-angle corner, for example, and is rounded at the ends and in the center. The angle cutout 23 is used for accommodating the pile thread 24. The pile thread 24 extends, for example, across the angle cutout 23 of the feed elements 6*a* and, following this, between the feed element 6*a* and 6*b*, to the feed element 5*a*, the needle assembly 3, and there across the angle cutout 28 and then between the feed elements 5*a* and 5*b* and back to the needle assembly 2 via the angle cutout 23 of the feed element 5*b*. This alternating of the pile thread 24 between the needle assemblies 2 and 3 is not obvious from FIGS. 5 and 6, but is absolutely necessary for connecting the two textile surfaces 29, 30. The two lamellas 21, 22 are positioned at a short distance to each other or fit against each other with slight pre-stressing. The pile thread 24 and the needles 2*a* to 2*c* with their respective hooks 25 can be moved between the two lamellas 21, 22 that belong to one and the same feed element, as shown in FIG. 5 with the aid of needles 2*a* to 2*c*. The lamellas 21, 22 in the process are moved apart slightly. The needle then can take over the pile thread 24 with its hook, in the form of a half loop, as shown in FIG. 5 with the needle 2*c* and the hook 25.

Figure 6:
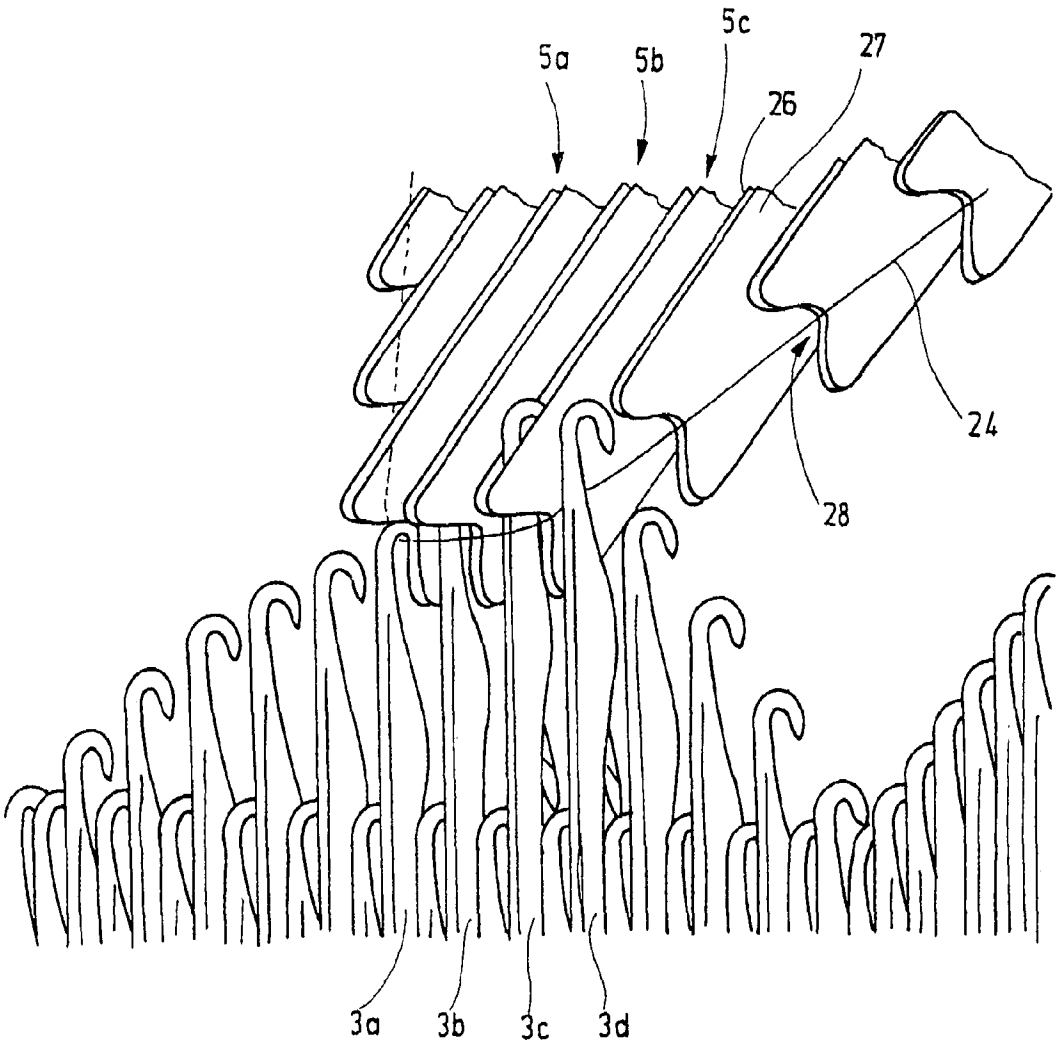
FIG. 6 illustrates latch needles of the knitting cylinder and feed elements, shown in a sectional perspective representation.

FIG. 6 illustrates the knitting system according to FIG. 7*a* with the aid of the needles 3*a*, 3*b*, 3*c*, 3*d* (and additional ones), belonging to the knitting cylinder 8, as well as the associated feed elements 5*a*, 5*b*, 5*c*, etc. The feed elements 5*a*, 5*b*, 5*c* (and additional ones) are preferably embodied identical to the feed elements 6*a*, 6*b*, and 6*c*. They are again provided with two lamellas 26, 27, which consist of flexible steel strips and fit against each other without significant pre-stressing. The needles of the knitting cylinder can move between these lamellas to take over the pile thread 24 that is positioned in the angle cutout 28 at the end.

The knitting machine 1 described so far operates as follows:

Reference is made to the embodiment according to FIGS. 1 to 4, which corresponds substantially to the configuration according to FIG. 8, wherein the description must correspondingly be applied to configurations according to FIG. 7 or 7*a*.

The needles 2*a* to 2*h* and 3*a* to 3*h* respectively operate by being extended and retracted. During the extending operation, they respectively allow the loop held by the hook to glide over the latch and onto the needle shank and simultaneously catch a thread with the hook. During the retracting operation, the loop sitting on the needle shank, from which the knit is suspended, glides toward the latch, encloses it and thus slides off via the closed hook. This process is referred to as transfer or knocking over. In the process, the closed hook pulls the previously picked up thread through the transferred loop, thus forming a new loop. This action is carried out repeatedly with the needles of the needle assembly 2, as well as with the needles of the needle assembly 3, thereby forming the knitted surfaces 29, 30 that are suspended from the needle assemblies 2, 3. Not shown, however, is that the knitted surfaces 29, 30 are connected by the legs of the pile thread 24. Starting with FIG. 1, FIGS. 2 to 4 illustrate how this thread is inserted into the knit by initially showing how the pile thread 24 is positioned in the angle cutouts 23, 28 of the feed elements 5*a* to 6*c*. The feed elements 5*a* to 6*c* here are preferably positioned at an angle to each other, so that they rest with their angle cutouts 23, 28 on a joint line occupied by the pile thread.

Figure 2:
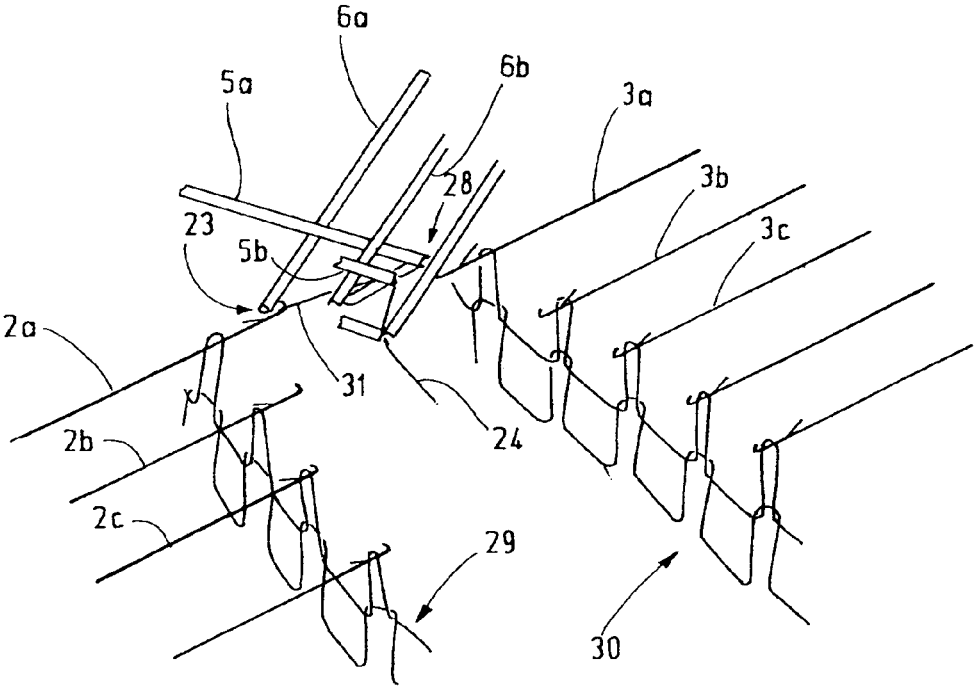
FIG. 2 shows the circular knitting machine according to FIG. 1 with the needles in the extended state and the pile thread fed in, shown in a schematic view.

If the pile thread 24 then forms a leg or loop extending between the knitted surfaces 29, 30, as shown in FIG. 2, the feed elements 5*a*, 6*a* as well as the feed elements 5*b*, 6*b* are extended, thereby causing the angle cutouts 23, 28 to move apart. At the same time, they approach each other in a plane defined by the two needle assemblies 2, 3, meaning the hooks, of the needles 2*a* to 2*h*, 3*a* to 3*h*. FIG. 2 illustrates the feed elements 5*a*, 6*a* in the most advanced position in which they clamp in or grip a pile thread leg 31, which is then taken over at both ends by the respectively extended needles 2*a*, 3*a*. These needles, as shown in FIG. 2, are preferably arranged offset by half a division relative to each other. The needles 2*b*, 3*b* and 2*c*, 3*c* furthermore start the extension movement, wherein the loops suspended thereon open the latches and glide over those latches and onto the latch shank. The feed elements 5*b*, 6*b* also start clamping in a pile thread leg.

Figure 3:
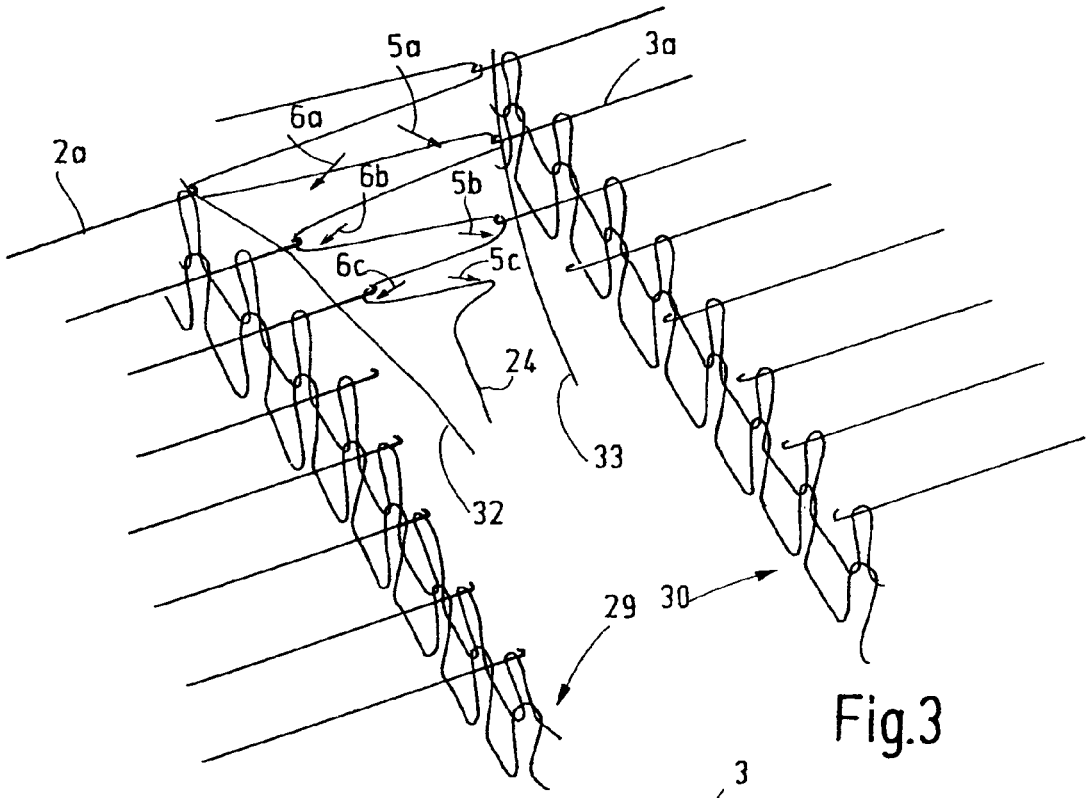
FIGS. 3 and 4 show additional working positions for the circular knitting machine when tying in the pile thread.
Figure 4:
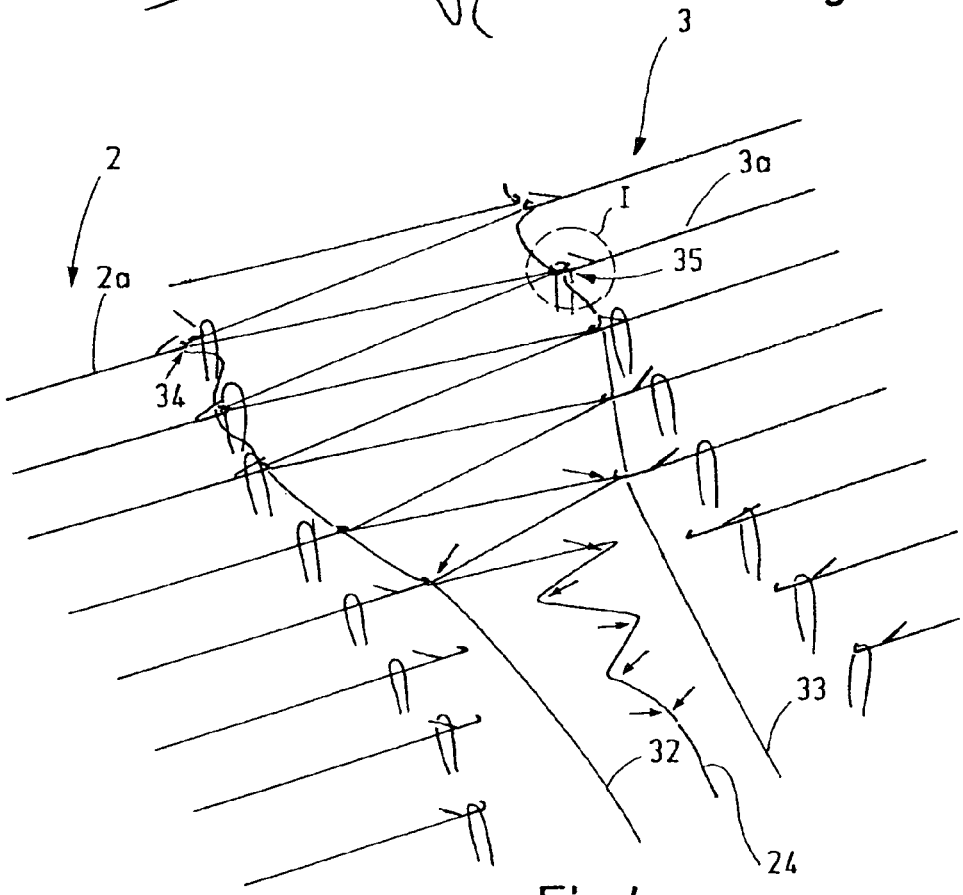
Figure 4A:
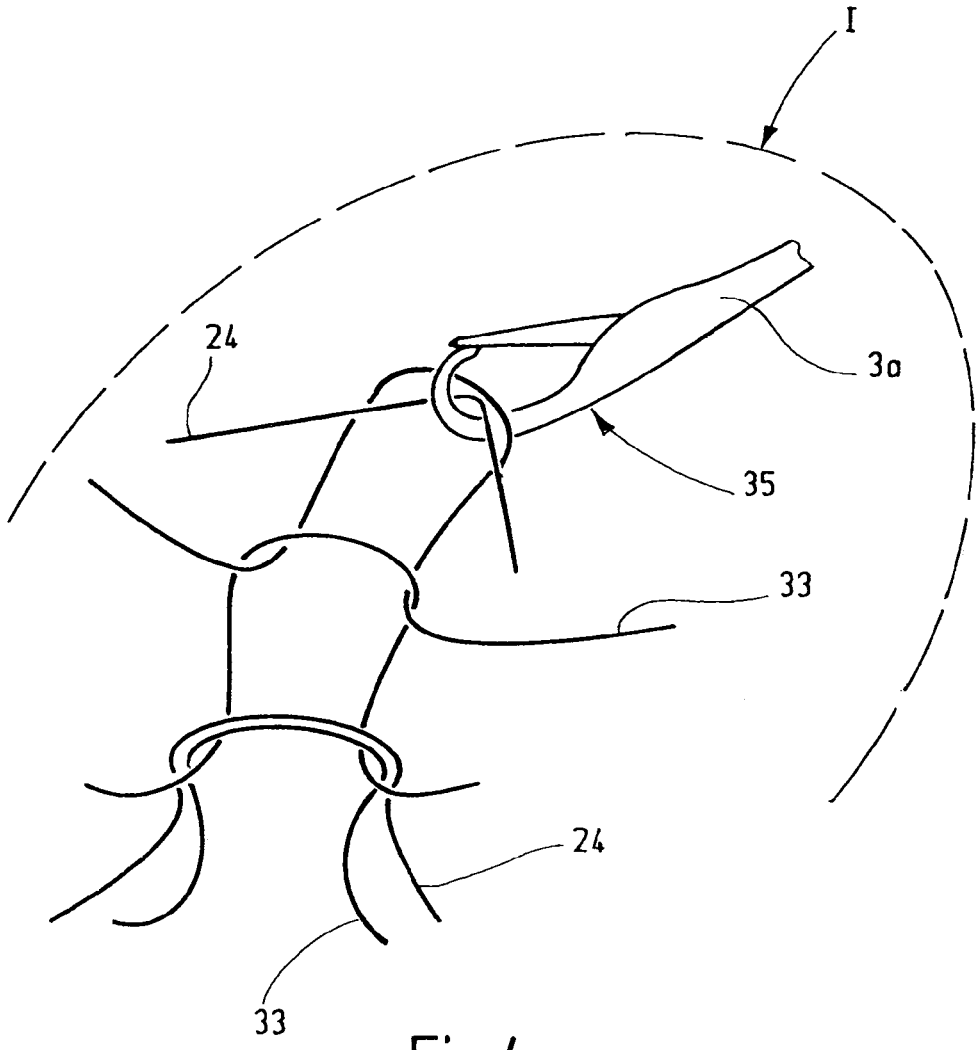
FIG. 4*a* is a representation of a detail from FIG. 4.

FIG. 3 illustrates the further progress in the knitting operation. To improve the clarity, the feed elements 5*a* to 5*c* and 6*a* to 6*c* are only indicated by arrows. As can be seen, the needles 2*a*, 3*a* have additionally picked up the threads 32, 33 for forming the loops for the knitted surfaces 29, 30 and are in the process of forming a new loop together with the pile thread 24 and knocking over of the respective half loop. This operation is completed in FIG. 4, which shows the needles 2*a*, 3*a* in the retracted position, wherein the pile thread 24 as well as the threads 32 and/or 33 are held in the hooks. During the further course, for example when the needle 2*a* is again extended, the pile thread 24 and the thread 32 slide onto the needle shaft by sliding over the inside edge of the latch that is in the retracted position. If the needle 2*a* is extended, a new thread 32 is inserted into the hook 25 to form the textile surface 29. With renewed retraction of the needle 2*a*, a new loop is then formed by knocking over the thread 32, which is initially is positioned on the needle shank and forms a half loop. The pile thread 24 is also knocked over and, in the process, is tied as tuck loop or tuck handle into the knitted surface 29. The described operational steps also apply correspondingly to needle 3*a* and all further needles. By tying in the pile thread 24, in the form of a tuck loop, into the knitted surfaces 29, 30, the distance between both knitted surfaces 29, 30 is fixed.

As shown, the needles of both needle assemblies 2, 3 are extended in the manner of a continuous wave. Synchronous thereto, the spreading apart of the feed elements 5*a* to 5*c* and 6*a* to 6*c* also occurs in the manner of a continuous wave. The pile thread 24 is tied into both knitted surfaces 29, 30 as tuck loop, wherein the loops are formed with the aid of threads 32 and/or 33. The pile thread 24 forms pile thread legs that move back and forth between the two knitted surfaces 29, 30 and, for the exemplary embodiment shown herein, connect all loops. If fewer pile thread legs are to be provided, the feed elements 5*a* to 6*c* are extended less often or fewer feed elements 5*a* to 6*c* are provided.

With the exemplary embodiment described so far, it was assumed that the feed elements 5*a* to 5*c* form a first assembly and the feed elements 6*a* to 6*c* form a second assembly, which are positioned on a joint line during the idle state. In the activated or transfer state, on the other hand, the feed elements 5*a* to 6*c* are respectively extended far enough, so that the associated needles 2*a* to 3*h* can take over the pile thread 24 from the angle cutouts 23, 28. In the transfer position, the exposed ends of the feed elements 5*a* to 6*c* overlap with the hooks of the extended needles.

Figure 9:
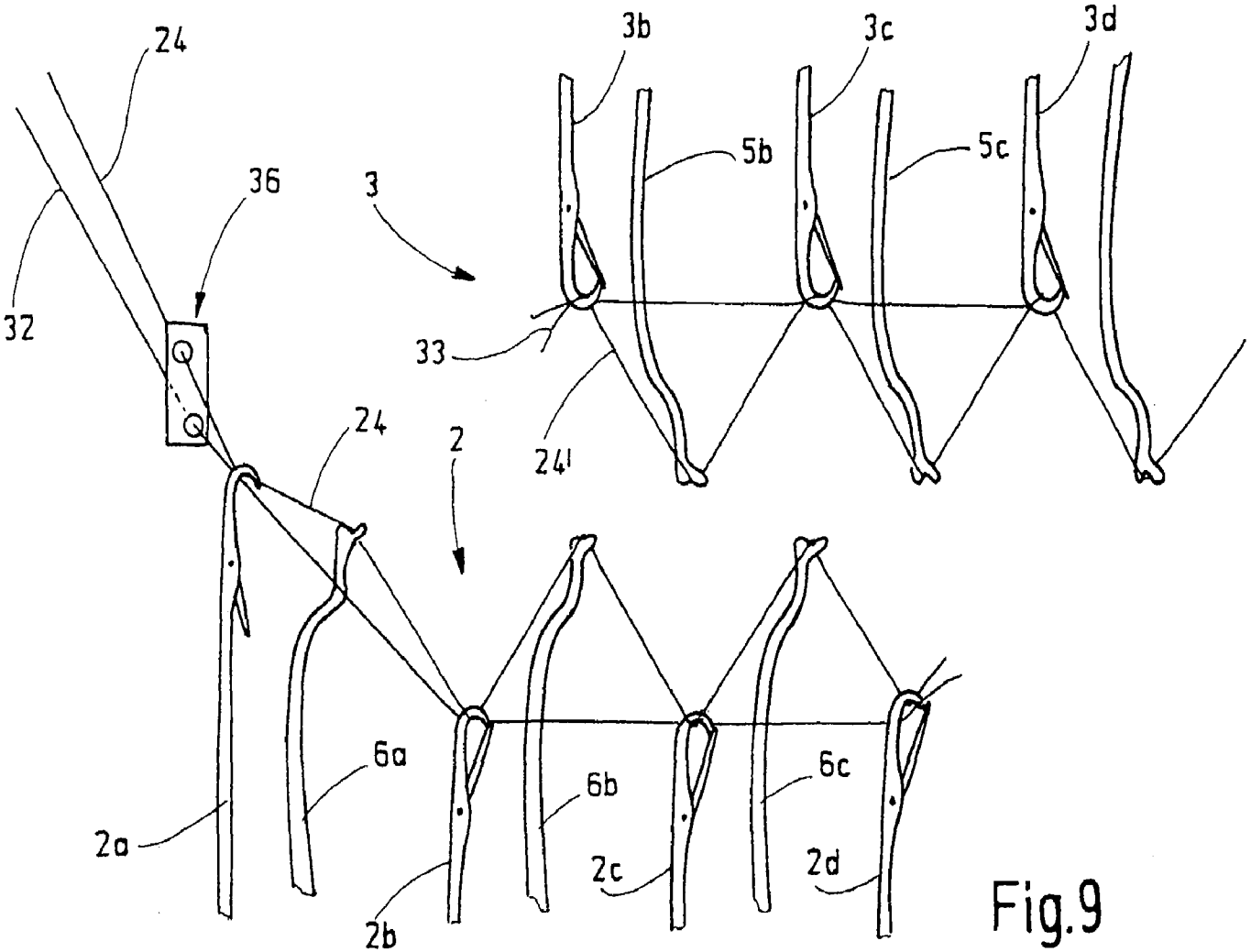
FIG. 9 illustrates a knitting system with feed elements integrated into the needle assembly, shown during the insertion of the threads; and, FIG. 10 is an illustration of the knitting systems according to FIG. 9 during the pile thread transfer and the loop forming.
Figure 10:
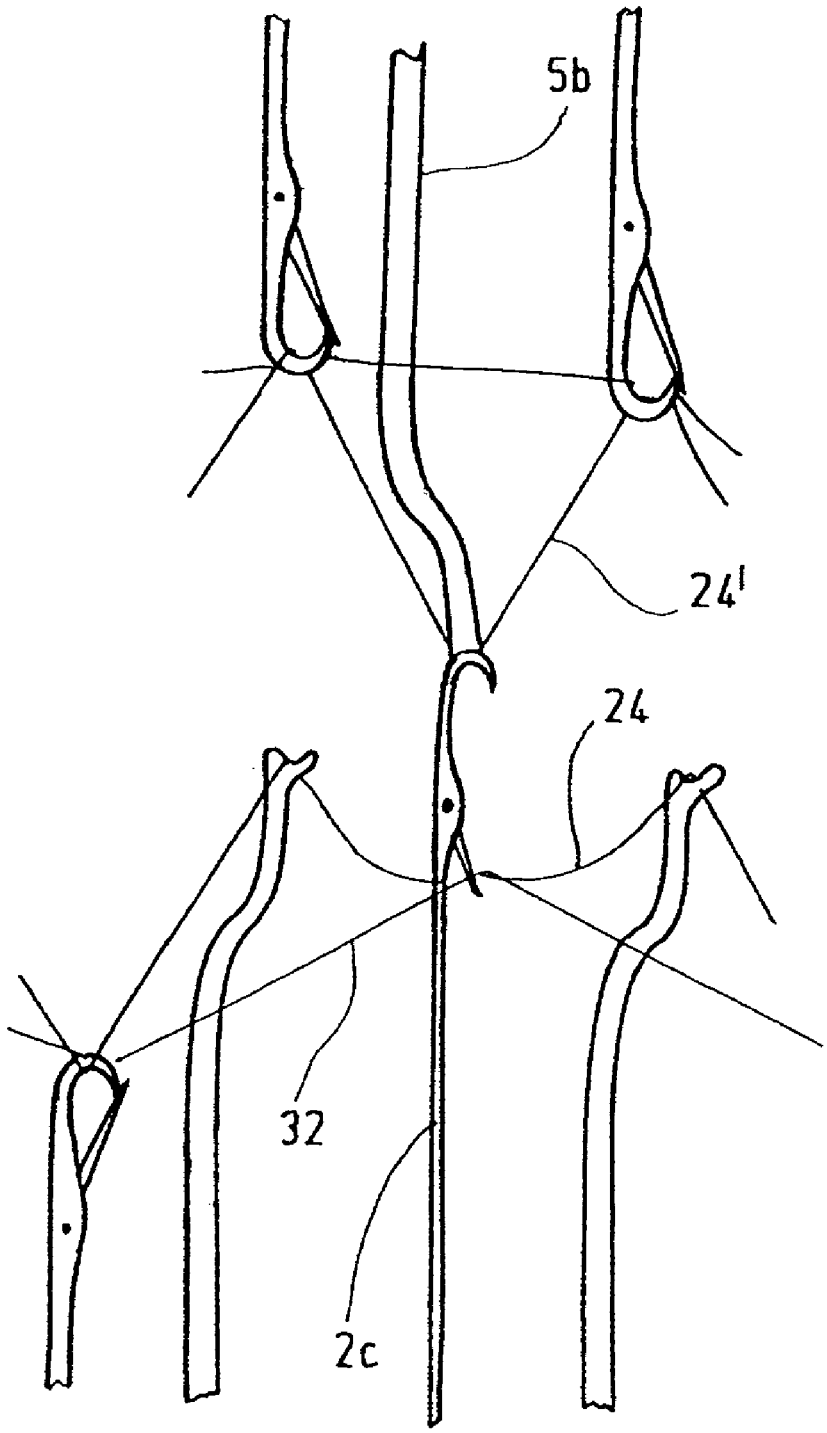

FIGS. 9 and 10 illustrate a modified embodiment with the aid of a basic representation, which is based on the fundamental configuration of a circular knitting machine with two knitting cylinders. The needle assembly 2 additionally contains the feed elements of group 6, wherein these can be arranged alternating with the needles. The needles 2*a* and 2*d* are again latch needles. The feed elements 6*a* to 6*c* are embodied as lamellas, which are provided at the ends with an angle cutout. A thread guide 36 functions to feed the pile thread 24 as well as an additional thread 32 to the needles 2*a* to 2*d* and the feed elements 6*a* to 6*c* of the one knitting cylinder. Correspondingly, needles 3*b* to 3*d* (latch needles) and feed elements 5*b*, 5*c* are also arranged alternately in the upper knitting cylinder. A pile thread 24' and an additional thread 33 are also fed to the knitting tools of the upper knitting cylinder.

For the thread guidance, the needles are extended far enough, so that the respectively extended needle grips the pile thread 24 as well as the additional thread 32. The feed element 6*a* is extended such that it only grips the pile thread 24, as shown on the lower left in FIG. 9. The needles and feed elements of the upper knitting cylinder operate in the same way. The feed elements 6*a* to 6*c* thus keep the feed thread in a zigzag line above the retracted needles 2*b* to 2*d*, wherein the same is true for the upper knitting cylinder.

The needles of the lower needle assembly 2 form a knitted surface shaped as a tube. The needles of the upper needle assembly 3 also form a knitted fabric in the form of a knitted tube, which is positioned coaxial to the first-mentioned knitted tube. Both knitted tubes are connected to each other with pile threads, wherein the connecting operation is illustrated in FIG. 10. The feed element 5*b* is extended far enough, so that the pile thread 24' carried by this component is moved into the tuck region for the opposite-arranged needle 2*c*, which then catches the pile thread and via this thread knocks over the previously held loop, consisting of pile thread 24 and thread 32.

The same operation is repeated with each feed element.

The apparatus according to the invention for producing a knitted fabric with interspacing can be embodied as circular knitting machine having two knitting cylinders or having a knitting cylinder and a dial. Between the two needle assemblies, defined in this way, a pile thread transfer device 4 is arranged, which is preferably provided with two groups 5, 6 of feed elements that can be moved respectively from an idle position into a thread-tucking position. In the process, the feed elements of the one group move toward the hooks of the needles from the first needle bed and the feed elements of the other group to the hooks of the needles from the other needle bed. In this way, it is possible to create knitted fabrics with interspacing on circular knitting machines, wherein latch needles can be used and the needle stroke is limited to the standard measure of less than 14 mm. The knitted fabric with interspacing can have a thickness of clearly more than 14 mm, meaning a thickness that far exceeds the needle stroke.

It will be appreciated that the above description of the present invention is susceptible to various modifications, changes and adaptations, and the same are intended to be comprehended within the meaning and range of equivalents of the appended claims.

REFERENCE NUMBER LIST

1 knitting machine
2,3 needle assembly
2*a*,2*b*,2*c*,2*d*,2*e*,2*f*,2*g*,2*h* needles
3*a*,3*b*,3*c*,3*d*,3*e*,3*f*,3*g*,3*h* needles
4 pile thread transfer device
5,6 groups
5*a*,5*b*,5*c* feed elements
6*a*,6*b*,6*c* feed elements
7,8 knitting cylinder
9 sinker ring
10,11 butts
12,13 cams, driving devices
14,15 guides
16,17 driving devices
18 dial
19,20 guide
21,22 lamellas
23 angle cutouts
24,24' pile thread
25 hooks
26, 27 lamellas (thin metal strips)
28 angle cutout
29,30 knitted fabric surfaces
31 pile thread legs
32,33 threads
34,35 loops
36 thread guiding device

The invention claimed is:

1. An apparatus for generating a knitted fabric with interspacing, having at least a first knitted surface and at least a second knitted surface, between which a pile thread extends that connects the two knitted surfaces and keeps them at a distance to each other, comprising:

a first group of needles that are positioned displaceable in a longitudinal direction inside a first needle bed, which is a knitting cylinder, and are connected to a driving device for the controlled movement in a longitudinal direction, with these needles forming a first needle assembly;

a second group of needles that are positioned displaceable in a longitudinal direction inside a second needle bed and are connected to a driving device for the controlled movement in a longitudinal direction, with these needles forming a second needle assembly;

a group of movably positioned feed elements, which are connected to a driving device for a controlled movement, with these feed elements having a functional section designed for guiding a pile thread; and wherein the feed elements are positioned inside a sinker ring, which is arranged concentric to the knitting cylinder.

2. An apparatus for generating a knitted fabric with interspacing having at least a first knitted surface and at least a second knitted surface, between which a pile thread extends that connects the two knitted surfaces and keeps them at a distance to each other, comprising:

a first group of needles that are positioned displaceable in a longitudinal direction inside a first needle bed and are connected to a driving device for the controlled movement in a longitudinal direction, with these needles forming a first needle assembly;

a second group of needles that are positioned displaceable in a longitudinal direction inside a second needle bed and are connected to a driving device for the controlled movement in a longitudinal direction, with these needles forming a second needle assembly;

a group of movably positioned feed elements, which are connected to a driving device for a controlled movement, with these feed elements having a functional section designed for guiding a pile thread; and wherein the feed elements are arranged in the first and in the second needle beds.

3. An apparatus for generating a knitted fabric with interspacing, having at least a first knitted surface and at least a second knitted surface, between which a pile thread extends that connects the two knitted surfaces and keeps them at a distance to each other, comprising:

a first group of needles that are positioned displaceable in a longitudinal direction inside a first needle bed and are connected to a driving device for the controlled movement in a longitudinal direction, with these needles forming a first needle assembly;

a second group of needles that are positioned displaceable in a longitudinal direction inside a second needle bed and are connected to a driving device for the controlled movement in a longitudinal direction, with these needles forming a second needle assembly;

a group of movably positioned feed elements, which are connected to a driving device for a controlled movement, with these feed elements having a functional section designed for guiding a pile thread; and wherein the feed elements are respectively provided with two flexible lamellas that face each other with the flat sides.

4. The apparatus according to claim 1, wherein the feed elements can respectively be moved between a passive position and a thread-transfer position.

5. The apparatus according to claim 1, wherein the feed elements are positioned so as to be displaceable in a longitudinal direction.

6. The apparatus according to claim 3, wherein the feed elements are positioned inside a special bed.

7. The apparatus according to claim 1, wherein the feed elements are arranged in pairs and are oriented at an angle to each other.

8. The apparatus according to claim 2, wherein the first needle bed is a knitting cylinder.

9. The apparatus according to claim 1, wherein the second needle bed is a knitting cylinder.

10. The apparatus according to claim 1, wherein the second needle bed is a dial.

11. The apparatus according to claim 1, wherein the sinker ring is provided with a group of first guides for a first group of feed elements and with a second group of second guides for a second group of feed elements.

12. The apparatus according to claim 11, wherein the guides for the first group and the guides for the second group are oriented at an angle relative to each other.

13. The apparatus according to claim 12, wherein the guides for the two groups are respectively oriented so as to be aligned at an angle of less than 45° relative to the needle slots of the respective needle bed and cooperate with the needles of this respective bed.

14. The apparatus according to claim 12, wherein the guides for the two groups are respectively oriented so as to be arranged parallel to the needle slots of the respective needle bed and cooperate with the needles of this respective needle bed.

15. The apparatus according to claim 2, wherein for the transfer of the pile thread to the needles of the opposite arranged assembly, the feed elements are extended further than the needles.

16. The apparatus according to claim 3, wherein the lamellas define between them a needle punch-in space.

17. The apparatus according to claim 1, wherein the feed elements are provided with an angular cutout at the end, designed to accommodate the thread.

18. The apparatus according to claim 1, wherein the needles are latch needles.

* * * * *